United States Patent [19]

Knappenberger

[11] 4,162,685

[45] Jul. 31, 1979

[54] BOVINE SURGICAL TABLE

[76] Inventor: George E. Knappenberger, P.O. Box 277, Haven, Kans. 67543

[21] Appl. No.: 756,791

[22] Filed: Jan. 4, 1977

[51] Int. Cl.[2] ..... A61D 3/00

[52] U.S. Cl. ..... 119/103

[58] Field of Search ..... 119/103, 98, 99

[56] References Cited

U.S. PATENT DOCUMENTS

| | | | |
|---|---|---|---|
| 1,455,101 | 5/1923 | Barlow | 119/103 |
| 2,408,872 | 10/1946 | Newbold | 119/98 |
| 2,510,703 | 6/1950 | Linton | 119/99 |
| 2,713,326 | 7/1955 | Stephenson | 119/103 X |
| 2,737,153 | 3/1956 | Dupont et al. | 119/103 |
| 3,026,846 | 3/1962 | Emmelkamp | 119/103 |

*Primary Examiner*—Hugh R. Chamblee
*Attorney, Agent, or Firm*—D. A. N. Chase

[57] ABSTRACT

A table is provided that allows easy surgical access to all parts of the bovine anatomy. Upon entering the table apparatus, the bovine is initially restrained by a stanchion-type head gate which is rapidly adjustable to accommodate a wide range of neck thicknesses. A squeeze cage or chute has sidewalls adjustable in spacing at the top and bottom independently by means of a lead screw arrangement that assures uniform contraction of the squeeze sides to the desired degree. In addition to this lateral restraint, the bovine is further restrained by a vertically adjustable back support which is brought down to bear on the back of the animal. The table can be rotated to any position through 360° about a longitudinal horizontal axis. In a rotated position, the floor sections of the table may be swung on offset hinges completely clear of the work area to provide access to the hooves and belly of the bovine. Access is provided to the sides of the animal by the provision of a plurality of selectively removable side panels on each of the squeeze sides of the cage. Besides being able to accommodate bovines of all sizes, the head gate upon completion of the procedure is instantaneously released to permit the bovine to move forwardly through the open exit opening thus provided.

18 Claims, 22 Drawing Figures

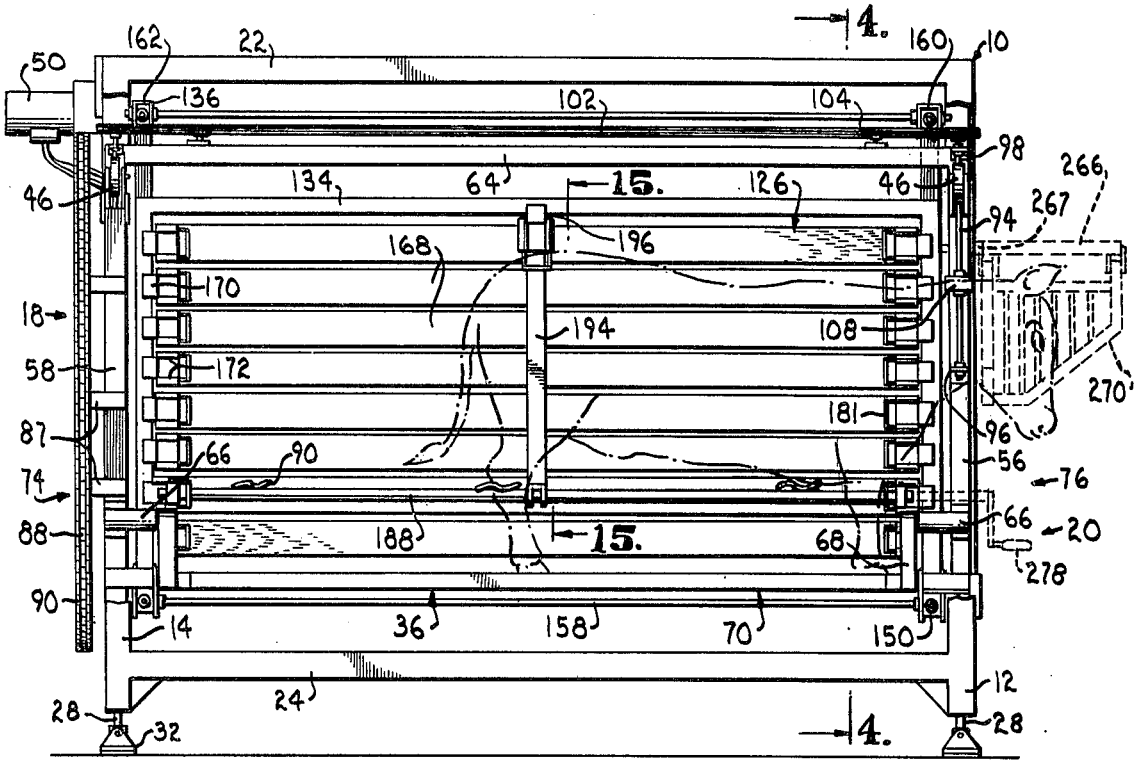
Fig. 1.
Fig. 2.
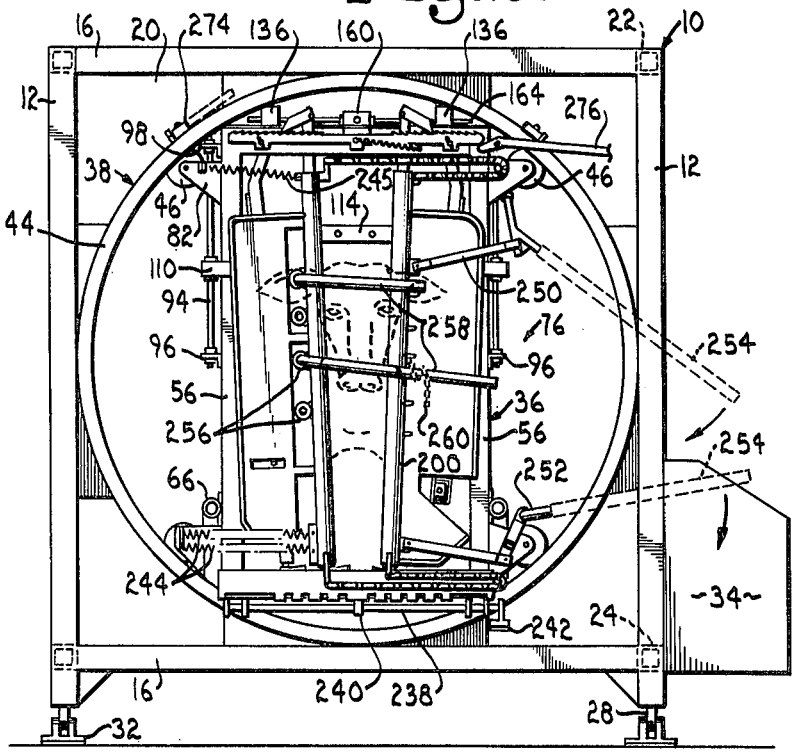
Fig. 14.
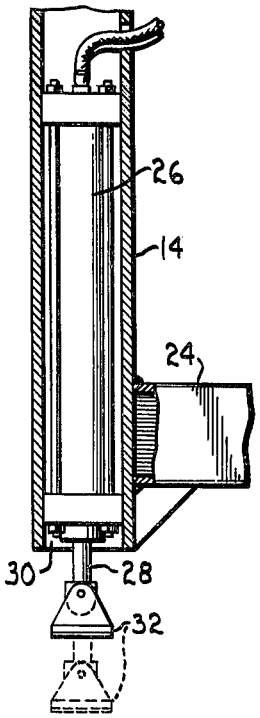

Fig. 6.
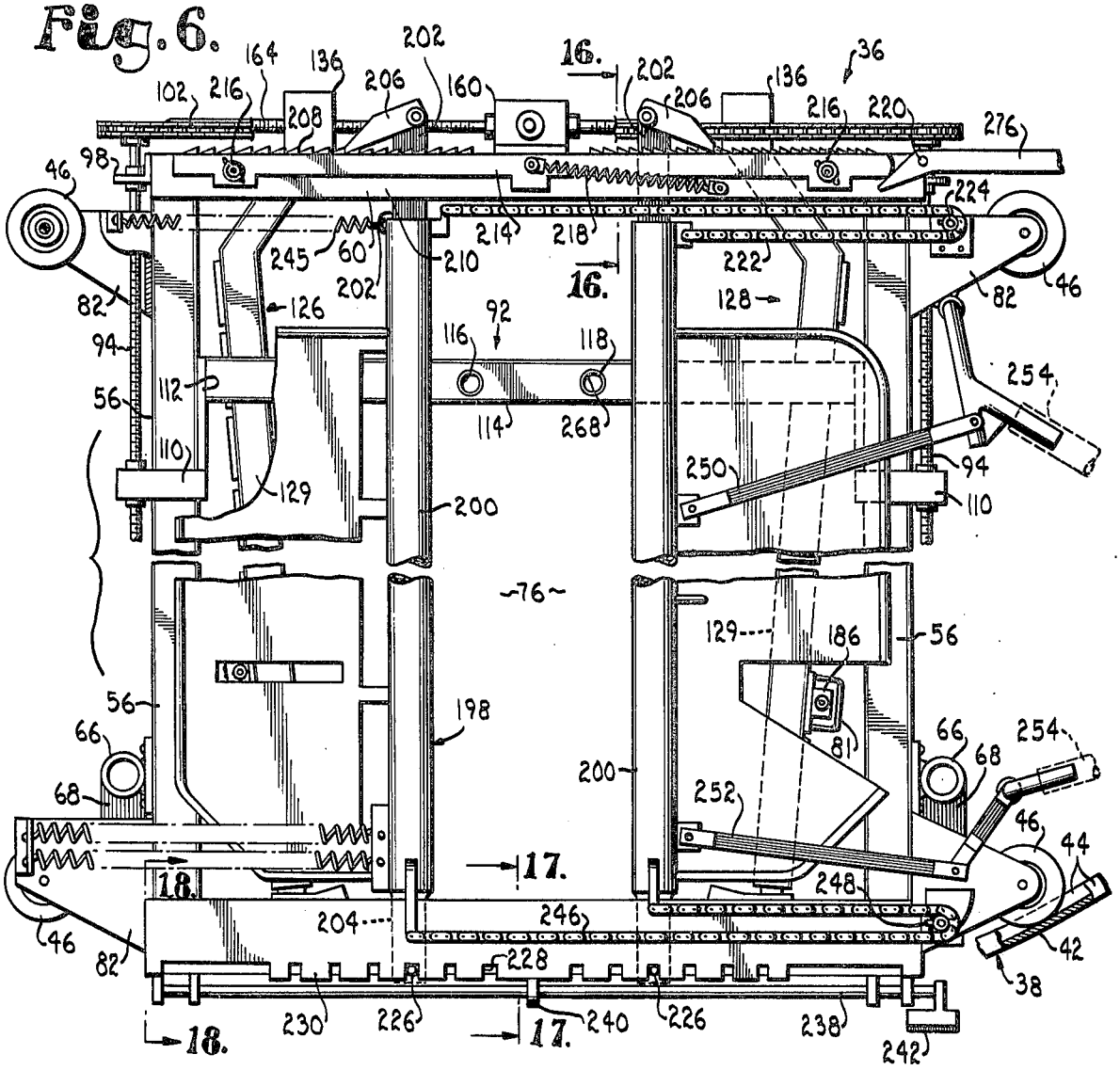
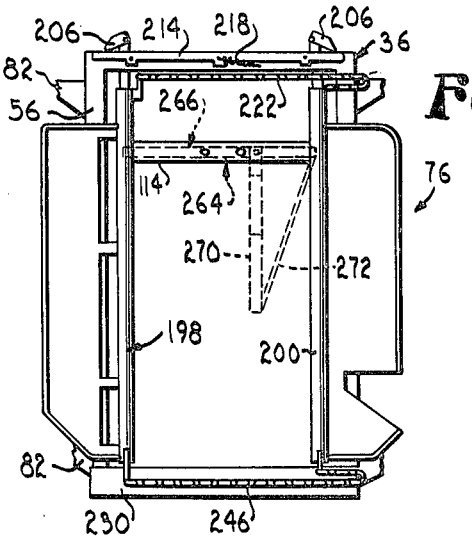
Fig. 7.
Fig. 16.
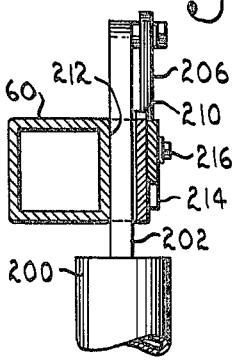

Fig. 8.
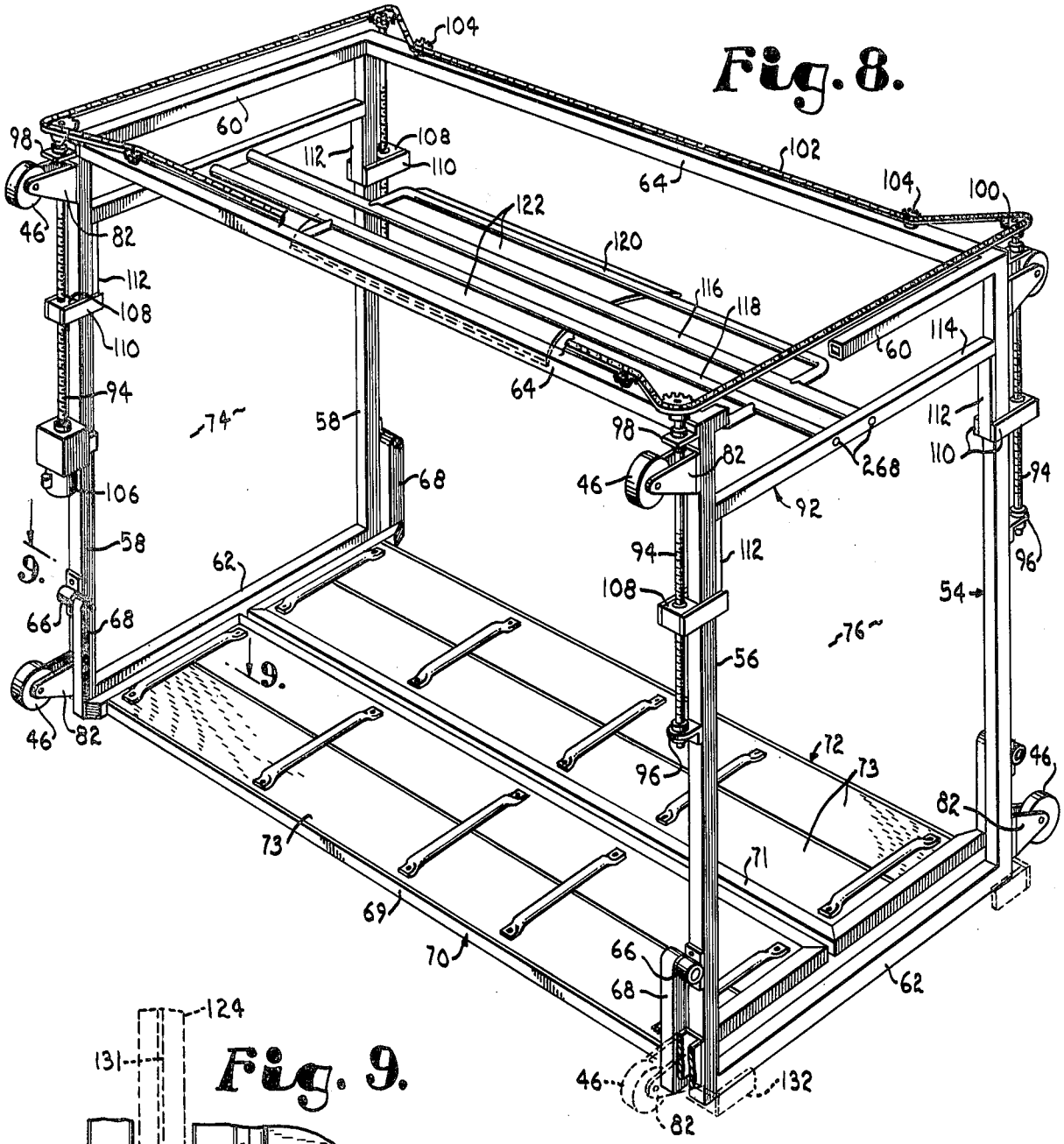
Fig. 9.
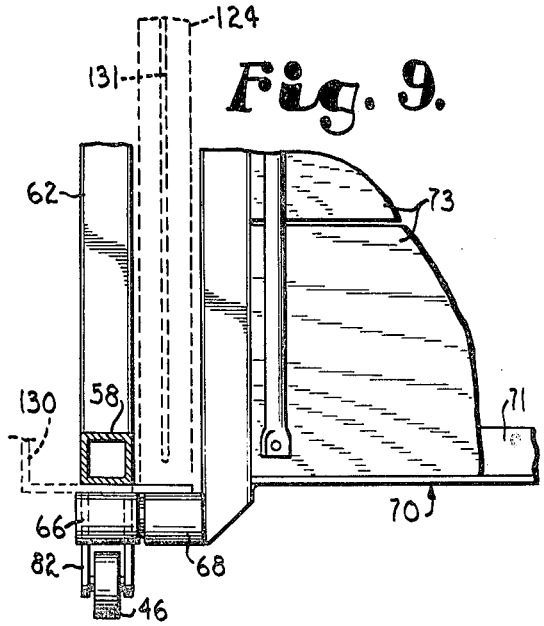
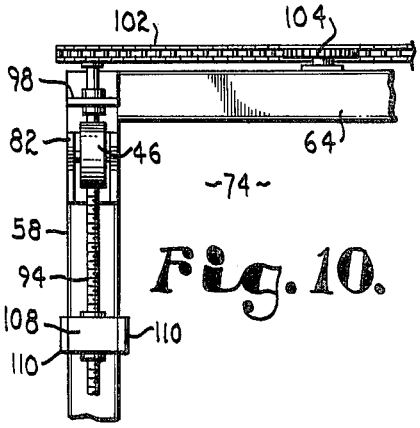
Fig. 10.

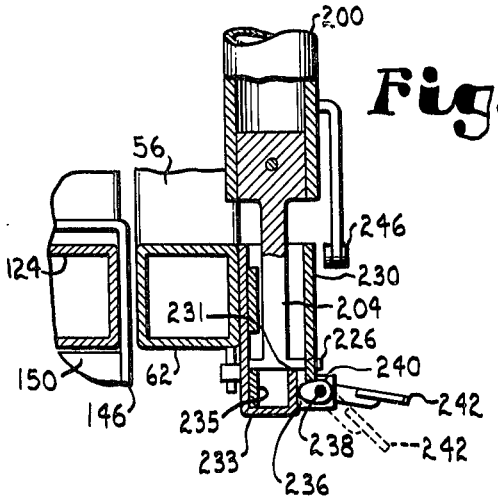
Fig. 17.
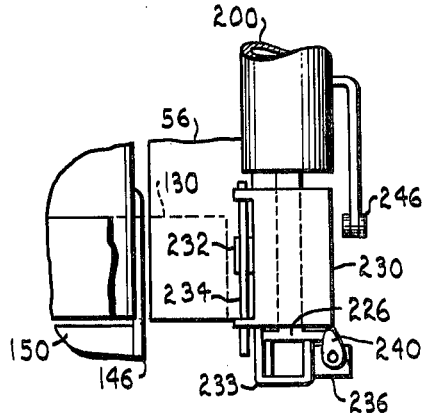
Fig. 18.
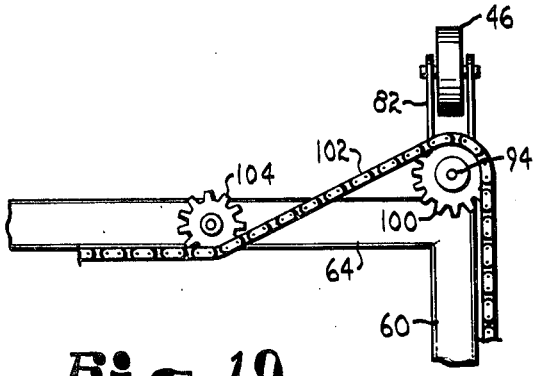
Fig. 19.
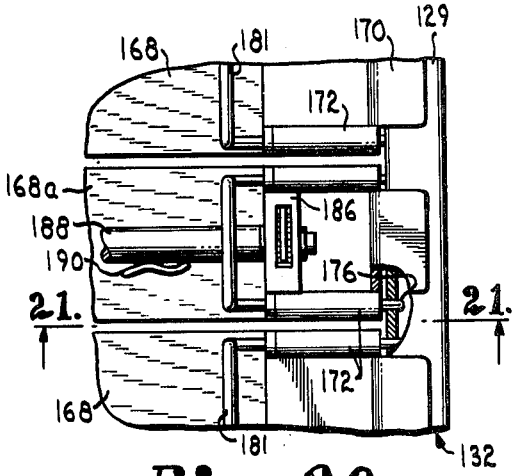
Fig. 20.
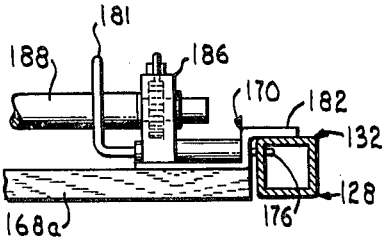
Fig. 21.
Fig. 22.
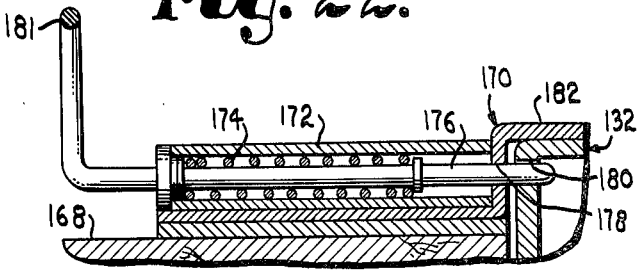

BOVINE SURGICAL TABLE

This invention relates to improvements in surgical tables used by veterinarians in the large animal practice and, in particular, to a table capable of efficiently handling bovine animals of all sizes with complete safety for both the bovine and the attending veterinarian, and which provides essentially unrestricted access to all parts of the bovine's body while at the same time providing the necessary restraint on the animal and support therefor.

The treatment and care of bovines is oftentimes made difficult due to the size of the animal. When it is necessary to use some type of restraint, there are considerations of both safety for the animal and safety for the attending veterinarian. Furthermore, it is desired that any restraining apparatus be capable of operation by one person if necessary, and have the capability of accommodating animals of all sizes without the necessity of time-consuming adjustments.

It is, therefore, an important object of the present invention to provide a bovine surgical table that will permit easy surgical access to all parts of the bovine anatomy, while at the same time properly restraining the animal without the use of belly bands or other restricting devices.

As a corollary to the foregoing object, it is an important aim of this invention to provide such a table that is safe for the operator and the animal alike, and that is comfortable for the animal by conforming to the bovine anatomy.

A further and important object of this invention is to provide a table as aforesaid that can be operated by one person quickly and efficiently in the event that additional assistance is not available.

Still another important object is to provide a table as aforesaid that will accommodate any size bovine animal up to approximately 3000 lbs., and which is rapidly adjustable so that one animal after another may be received for a treatment procedure without the need to make time-consuming adjustments for the size of each animal treated.

Specifically, it is an important object of this invention to provide a bovine surgical table with a stanchion-type head gate that will quickly and easily accommodate various neck thicknesses and that, upon completion of the procedure, will instantly release the animal.

A further and specific object is to provide such a table having a cage or chute provided with squeeze sides that are independently adjustable at both the top and bottom to conform to the bovine anatomy, and wherein the contraction of the sides to squeeze or support the animal is rapidly accomplished by relatively simple mechanical means.

Still another important and specific object is to provide squeeze sides as aforesaid having selectively removable panels so that unrestricted access is provided to the animal's body.

Another specific, important object of the invention is to provide a bovine surgical table having a vertically adjustable back support which may be brought down in contact with the back of the bovine, and which positively and comfortably supports the animal upon rotation of the restraining cage to positions of lateral or dorsal recumbency.

Additionally, it is a specific and important object to provide such a table with a floor which can be quickly and easily moved completely clear of the work area once the animal is restrained and rotated to the desired position, for those procedures in which access to the hooves and belly of the animal is required.

In the drawings:

FIG. 1 is a fragmentary, side elevation view with the head rest (at the front or right end) shown in broken lines;

FIG. 2 is a front elevation (right end view) of the surgical table apparatus shown in FIG. 1, looking directly at the head stanchion;

FIG. 6 is an enlarged, fragmentary, front elevation of the cage structure;

FIG. 7 is a partial schematic on a reduced scale illustrating the head stanchion in its fully open position;

FIG. 8 is an enlarged, frontal perspective view of the internal cage frame;

FIG. 9 is an enlarged, fragmentary, horizontal sectional view taken along line 9—9 of FIG. 8, showing the floor hinging means;

FIG. 10 is a fragmentary elevation on the same scale as FIG. 9 illustrating one of the raising and lowering screws that controls the back support frame;

FIG. 14 is a fragmentary elevation of one of the adjustable legs of the outer support frame of the table apparatus;

FIG. 16 is an enlarged, fragmentary, vertical sectional view taken along line 16—16 of FIG. 6, showing the top of one of the stanchion elements;

FIG. 17 is an enlarged, fragmentary, vertical sectional view taken along line 17—17 of FIG. 6, showing the bottom of one of the stanchion elements and the lifting cam;

FIG. 18 is an enlarged, fragmentary elevation of the lower portion of the stanchion structure, the view being taken along line 18—18 of FIG. 6;

FIG. 19 is an enlarged, fragmentary plan view illustrating the drive that raises and lowers the back support frame;

FIG. 20 is an enlarged, fragmentary elevation showing the outside faces of three of the removable side restraining panels at one end thereof, and also illustrating the leg restraining winch;

FIG. 21 is a cross-sectional view taken along line 21—21 of FIG. 20; and

FIG. 22 is a greatly enlarged, fragmentary, longitudinal cross-sectional view of one of a pair of springloaded locking devices mounted on each end of each removable side panel.

THE EXTERNAL FRAME

Figure 3:
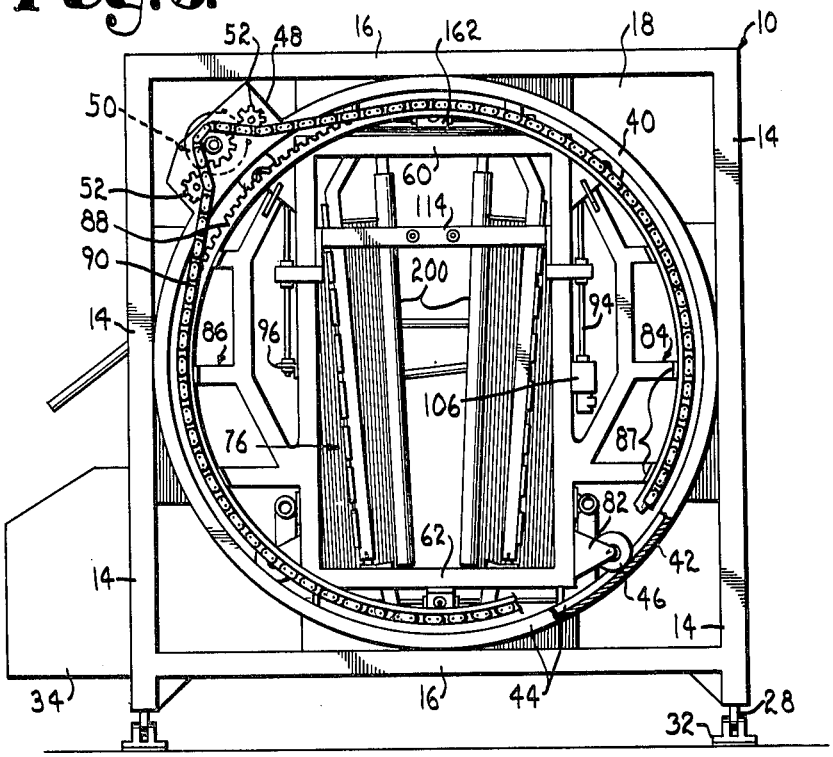
FIG. 3 is a rear elevation (left end view) of the apparatus of FIG. 1 and illustrates the drive for the rotatable, bovine-restraining cage.
Figure 15:
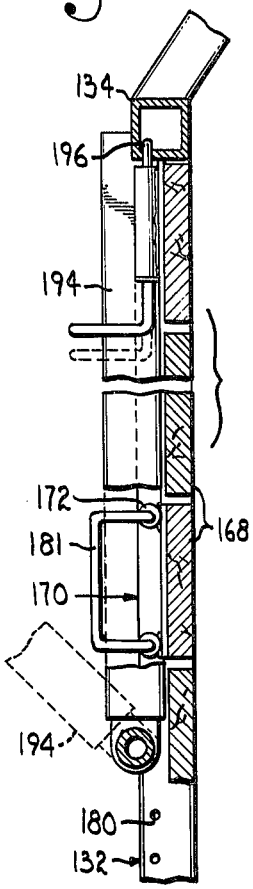
FIG. 15 is an enlarged, fragmentary, vertical sectional view taken along line 15—15 of FIG. 1, showing the removable panels of the side restraining walls.

Referring to FIGS. 1–4, the bovine surgical table of the present invention has a rectangular external frame 10 that includes a pair of front end, vertical tubular frame members 12 and a pair of rear end, vertical tubular members 14. Each end of the frame has upper and lower horizontal transverse frame members 16 defining a rear opening or drive end 18 and a front opening or exit end 20. Parallel upper and lower longitudinal frame members 22 and 24 respectively complete the rigid, stationary external frame 10.

Mounted within and secured to the lower portions of the tubular vertical frame members 12 and 14 are downwardly extending hydraulic cylinders 26 (as best shown in FIG. 14). Each cylinder 26 is rigidly installed within the respective vertical member and has an extensible piston 28 projecting through its open bottom end 30. Pivotable ground support pads or feet 32 are secured to the ends of the pistons 28.

The cylinders 26 are operably connected by suitable hydraulic lines to a control console 34 which includes a hydraulic pump and reservoir (not shown) for selectively activating the cylinders 26. This allows the operator to raise or lower the external frame 10 and thus the smaller rotatable internal restraining cage 36. Being located at each of the four corners of the frame 10, the four cylinders 26 can be activated in pairs to tilt the table or employed to adjust the height of the entire apparatus uniformly as a unit.

Front and rear circular track members 38 and 40 are rigidly secured to the frame 10 and mounted within the front and rear openings 20 and 18 respectively in longitudinally axially aligned relationship with the frame. The circular tracks 38 and 40 are U-shaped in cross-section and have their base portions 42 welded to the vertical and transverse frame members of the frame 10. Integral, inwardly extending, parallel sidewalls 44 of each track define a guide or channel for receiving corresponding wheels 46 mounted on and supporting the internal restraining cage 36.

The rear track 40 includes an enlarged portion in the upper left quadrant as seen in the rear view of FIG. 3, forming a mounting plate 48 for a combination hydraulic motor 50 and chain-tightening gears 52. The hydraulic motor 50 is operably connected to the console 34 by lines (not shown) and provides the drive to rotate the internal cage 36.

INTERNAL ROTATABLE RESTRAINING CAGE

The smaller rectangular internal restraining cage 36, as best shown in FIG. 8, also comprises a rigid central frame 54 having pairs of front and rear, normally vertical frame members 56 and 58 and upper and lower pairs of parallel, transverse, tubular frame members 60 and 62, but having only a pair of upper longitudinal frame members 64. A pair of side-by-side floor sections 70 and 72 fill the horizontal space between the lower members 62, and each is mounted by a pair of normally upwardly extending arms 68 at its outside corners. Adjacent the lower ends of the vertical frame members 56 and 58 are sleeve bearings 66, each of which receives a bearing part on the upper end of a corresponding arm 68 to form an offset hinge arrangement for each of the floor sections or halves 70 and 72. Accordingly, a rigid rotatable internal cage is provided having a drive end 74 (entrance) and an exit end 76.

The internal cage 36 is supported and rotated within the external frame 10 and its circular tracks 38 and 40 by two sets of four spaced-apart wheels 46. The wheels 46 are mounted within outwardly extending ears 82 projecting transversely from the vertical pairs of front and rear frame members 56 and 58 adjacent the corners of the frame 54.

Extending outwardly from the rear vertical frame members 58 at the drive end 74 (as best shown in FIG. 3, and deleted from FIG. 8 for clarity) is a series of right and left braces 84 and 86 to rigidly support a large, open, chain-driven gear or sprocket 88. The braces 84 and 86 extend horizontally towards but terminate prior to the annular track 40 and have integral, rearwardly extending spacer plates 87. The spacer plates 87 extend from internal cage 36 through the rear opening at the drive end 74 and through the rear opening 18 of the external frame 10, and rigidly support the open gear 88. An endless chain 90 connects the drive gear 88 to the hydraulic motor 50 and the chain-tightening gears 52 in order to rotate the internal cage 36 to any desired position.

Each of the hinged floor sections 70 and 72 includes a rectangular frame 69 and 71 respectively. Mounted within each framework are a pair of longitudinal wooden floor planks 73 of sufficient thickness to support the weight of large bovines. Both the left floor section 70 and the right floor section 72 are hingedly connected to the vertical frame members 56 and 58 by the previously described upwardly extending arms 68. It should be noted that the weight of the floor sections themselves will normally urge them toward a closed position by virtue of the offset hinge arrangement, as will be more fully discussed in the operation section of this specification.

The internal cage 36 also includes a vertically adjustable back support means 92 having four vertically mounted, parallel, rotatable threaded shafts 94 on the respective front and rear vertical frame members 56 and 58. The threaded shafts are received by lower bearings 96 located intermediate the ends and upper bearings 98 mounted adjacent the upper ends of the respective members 56 and 58. Each of the threaded shafts 94 is provided with a sprocket 100 on its uppermost end. A continuous timing chain 102 is trained around all four sprockets 100. Chain-tightening gears 104 are mounted on the longitudinal frame members 64 of the internal cage 36 adjacent the sprockets 100 and engage the chain 102. A reversible electric motor 106 is mounted on one of the rear vertical frame members 56 and, through reduction gearing, drives one threaded shaft 94 to rotate its sprocket 100 and the chain 102, thereby rotating all of the shafts 94 in unison.

Any rotation of the threaded shafts 94 will axially shift four mating threaded blocks 108 mounted on respective shafts 94 to raise or lower the adjustable back support means 92. Each of the front and rear pairs of vertical frame members 56 and 58 acts as a vertical guide for the adjustable back support. The threaded blocks 108 bear against the sides of the frame members and are provided with inwardly extending pairs of fingers 110 that capture the respective vertical members. An upstanding vertical extension 112 carried by the inner ends of each pair of fingers 110 cooperates therewith to form a movable sleeve. Secured to the upper ends of the vertical extensions 112 and extending transversely between the vertical frame members are a pair of parallel, tubular, transverse end brackets 114. A pair of parallel, longitudinal bars 116 and 118 span the end brackets 114 and are each provided with an elongated, U-shaped outrigger brace 120. Sectional, curved back support plates 122 are carried by the bars and braces and thus form a contoured, vertically adjustable back support 92 to accommodate bovines of various heights.

Figure 11:
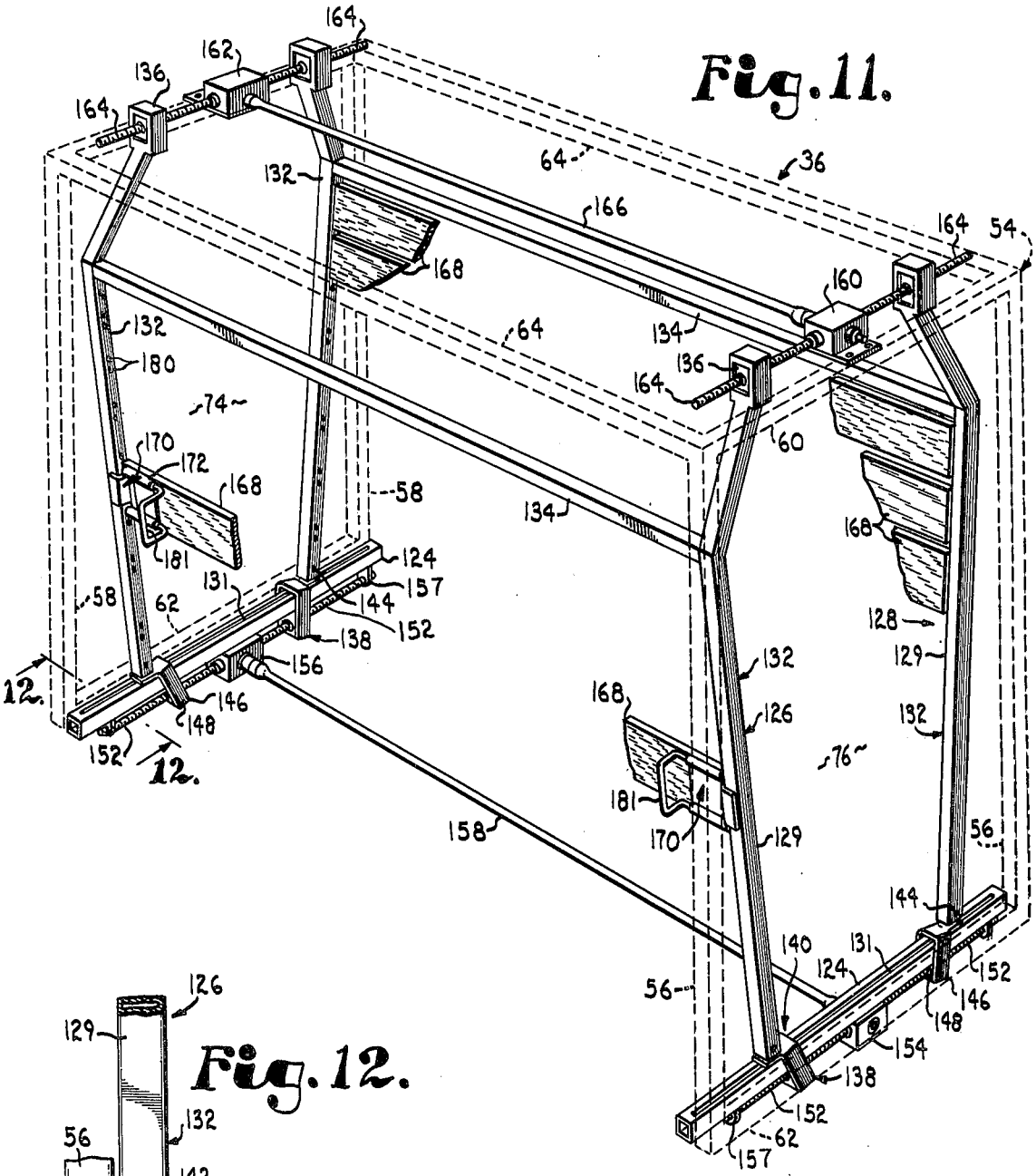
FIG. 11 is a frontal perspective view on the same scale as FIG. 8 and shows the adjustable sidewalls (fragmentarily) of the cage and their supporting members, the cage frame (FIG. 8) being illustrated in broken lines.

It should be noted that the rotatable internal cage 36 supports various movable structures and that in order to clarify the illustration of the interrelated systems, it has been necessary herein to show each movable system separately in the drawings. Thus, FIG. 8 illustrates the frame structure of the internal cage 36, hinged floor means and the adjustable back support 92. FIG. 11 illustrates the adjustable sidewalls which are mounted on the cage frame 54.

THE ADJUSTABLE SIDEWALLS

Figure 12:
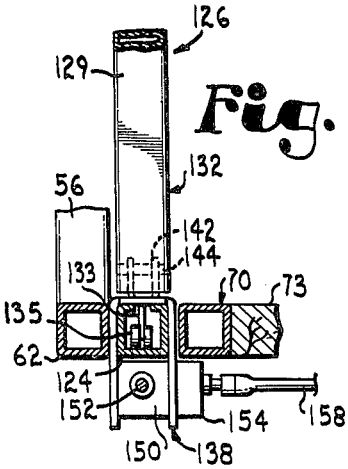
FIG. 12 is an enlarged, fragmentary, vertical sectional view taken along line 12—12 of FIG. 11.
Figure 13:
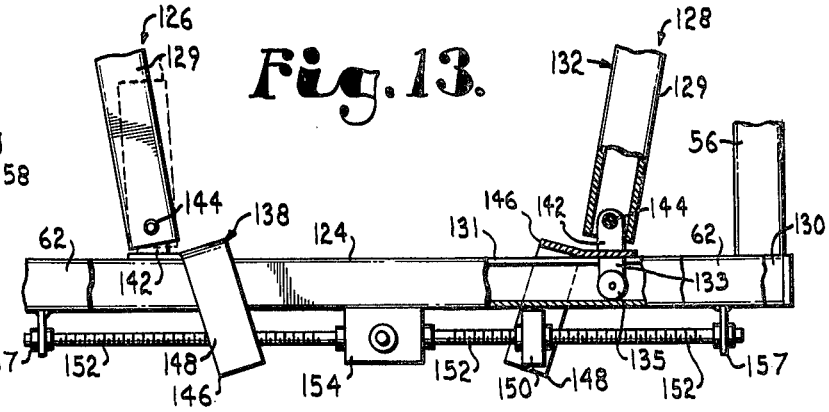
FIG. 13 is an enlarged, fragmentary, front elevational view of the sidewall supporting structure shown in FIG. 11, parts being broken away to better illustrate the sidewall adjusting means.

The rigid internal cage frame 54 (shown in phantom lines, FIG. 11) supports a pair of elongated, tubular, transversely extending sidewall guides 124 for the left and right adjustable sidewalls 126 and 128. Each of the guides 124 is mounted inwardly from and in closely spaced, parallel relationship with a corresponding transverse frame member 62 by elongated, U-shaped end plates 130 (FIG. 9). As best shown in FIG. 12, the sidewall guides 124 are located between the frame members 62 and the hinged floor sections 70 and 72 and are slightly spaced from each. A lengthwise slot 131 in the upper wall of each guide 124 receives two downwardly extending ears 133 therethrough (FIGS. 12 and 13). Each ear 133 is provided with a loading bearing wheel 135 for the vertical wall support frames which rides on the lower internal wall surface of the guide 124. Each ear portion 133 is an integral extension of a corresponding bracket 138 described below.

The transversely adjustable left and right (as viewed from the exit end in FIG. 11) sidewalls 126 and 128 include a pair of hinged, upright, angular, front tubular wall support frame members 129, a similar pair of upright rear members 132, and a pair of longitudinal braces 134 interconnecting members 129 and 132. The inwardly angled upper portion of each of the four upright members 129 and 132 is provided with an enlarged upper end that houses a self-aligning, internally threaded sleeve 136. Each bracket 138 is of inverted U-shape, embraces the corresponding sidewall guide 124 and is hinged on the lower end of the associated member 129 or 132 by a pin 144 that extends through an upstanding, integral ear 142 received within the open lower end of the member 129 or 132.

A slidable base portion 140 is provided by each pair of U-shaped bearing brackets 138 and rests on the upper, slotted wall of the corresponding sidewall guide 124. Each base portion 140 includes a pair of upwardly inclined plate portions 146 each having downwardly extending walls 148 on either side of the sidewall guide 124, such plate portions 146 and walls 148 being presented by the bights and wings of the brackets 138. Carried between each pair of walls 148 and mounted immediately below the lower surface of the guide are a pair of internally threaded sleeves 150 receiving a rotatable lead screw 152 extending parallel to the guide 124. Centrally located on the front and rear guides 124 and mounted therebeneath are a pair of manually operated, lower, front and rear gear boxes 154 and 156. As shown in FIG. 13, the lower, front lead screw 152 extends outwardly from both sides of the gear box 154, is received by the two sleeves 150, and terminates in end bearings 157 mounted on the lower surface of the front guide 124.

The lower gear boxes 154 and 156 are mechanically interconnected by an elongated, removable crank shaft 158. When the internal cage 36 is rotated and the floor sections 70 and 72 are moved out of the way, the shaft 158 is temporarily removed to provide unhindered access to the belly portion of the bovine, and is replaced when desired.

A pair of front and rear, manually operated gear boxes 160 and 162 are centrally mounted and suitably secured to the upper, front and rear transverse frame members 60 of the internal frame 54. Outwardly extending lead screws 164 are received in the self-aligning threaded sleeves 136 mounted in the aforementioned upper ends of the sidewall support frames 129 and 132. The upper, front and rear gear boxes 160 and 162 are also mechanically interconnected by a longitudinally extending crank shaft 166.

Both the upper and lower set of gear boxes are manually activated by a hand crank (not shown), which in turn rotates the lead screws 152 and 164 to cause the contraction or expansion of the left and right sidewalls 126 and 128. Since the upper and the lower gear boxes may be independently operated, it is thus possible to independently expand or squeeze the sidewalls 126 and 128 at the top and the bottom to conform to the approximate contour of the bovine. This allows the animal to be properly supported during rotation of the internal cage 36 and also restrains the animal to prevent unwanted movement.

Each of the sidewalls 126 and 128 includes a plurality of parallel, removable side panels 168. The side panels 168 extend longitudinally between the front and rear upright frame members 129 and 132. Adjacent each end of the panels 168 are generally Z-shaped, side panel locking devices 170.

As best shown in FIGS. 20–22, each of the side panel locking devices 170 comprises a pair of parallel tubular sleeves 172 on the outer surface of the panel 168 having springs 174 therein urging a pair of locking pins 176 through openings 178 in the locking device and into openings 180 in the vertical frame members 129 or 132. The upper portion 182 (as viewed in FIG. 22) of the Z-shaped locking device 170 extends over the outside of the frame member for proper alignment and support during installation. An interconnecting handle 181 allows the operator to withdraw the two locking pins 176 simultaneously. Any number of side panels 168 may be removed as needed to provide unrestricted access to the ventral parts of the bovine while the remaining panels supply the needed support.

Referring to FIGS. 20 and 21, the second panel **168*a* from the bottom on each side includes a manually operated winch 186 provided with a rotatable shaft 188 extending the length of the side panel 168*a*. Spaced-apart cleats 190 are welded to the shaft 188** for securing the bovine's feet with rope.

A vertical brace 194 is centrally located on each side and is swingably attached at its lower end to the shaft 188. A locking device 196 similar to 170 on the upper end of each brace 194 releasably secures the same to the associated horizontal brace 134. The vertical braces 194 prevent the bovine from bowing out or deforming the panels during squeezing and rotation, but thereafter the operator may swing the selected brace 194 out of the way and remove as many side panels 168 as desired once the table is in position.

HEAD STANCHION DEVICE

The restraining cage 36 is also provided with a head stanchion device 198 mounted on the front or exit end 76. See particularly FIGS. 2 and 6. The head stanchion 198 consists of a pair of opposed, simultaneously movable, upright posts 200, each having integral, axially projecting, upper and lower guide plates 202 and 204 respectively.

A pair of pivotable dogs 206 are mounted on the upper ends of the respective upper vertical guide plates 202 and engage the ratchet-toothed upper edge 208 of an elongated, transversely extending, overhead plate 210 rigidly secured at each end to the front transverse frame member 60 of the frame 54. The dogs 206 are biased downwardly as viewed in FIGS. 2 and 6 by springs (not shown) to assure constant engagement with toothed edge 208. Intermediate its ends the plate 210 is spaced forwardly from the member 60 to form a slot 212 (FIG. 16) wherein the upper guide plates 202 are aligned and extend therethrough. The plate 210 carries a slidable dog clearing bar 214 having a diagonal slot and pin arrangement 216 adjacent each of its ends. A spring 218 urges the clearing bars 214 toward a normally downward, inoperative position. An upper stanchion spacing chain 222 is secured at its ends to the upper ends of the posts 200 and is trained around an idler gear 224 mounted on one of the upper sets of ears 82.

The lower guide plates 204 are provided with locking pins 226 projecting forwardly and rearwardly from their lower ends (FIG. 17) which are held by a series of notches 228 in the lower edge of a transversely extending, vertically shiftable drop bar 230. As is best shown in FIG. 17 the locking pins 226 ride on an upturned edge 231 of a transversely U-shaped plate 233 secured to the lower transverse frame member 62, and the upper edge of a smaller plate 235 within the U-shaped plate 233. Both of the plates 233 and 235 extend parallel to such member 62 and, therefore, normally horizontally beneath the stanchion 198.

Referring to FIG. 18, a pair of vertical sleeves 232 are welded to the cage frame at the respective lower front corners thereof formed by the upright frame members 56 and the front transverse frame member 62. One such sleeve 232 is shown in FIG. 18 and receives a vertical pin 234 carried by the drop bar 230 at a corresponding end thereof. The same arrangement exists at the opposite end of the drop bar 230 to permit limited vertical reciprocation of the drop bar 230 so that it may be raised clear of the locking pins 226. A normally horizontally extending, transverse shaft beneath the drop bar 230 carries a release cam 240 and is activated by a foot pedal 242 (FIG. 6). By manually depressing the foot pedal 242 (which presents a crank arm rigid with the shaft 238), the cam 240 is raised to engage the lower edge of the drop bar 230 and shift the same upwardly. Once the locking pins 226 are no longer held by the notches 228, a pair of springs 244 in tension secured to the lower end of the left post 200 are permitted to act. A lower spacing chain 246 has its ends attached to the lower ends of the posts 200 and is trained around an idler gear 248; therefore, the posts 200 are separated by spring action in a uniform manner so that equal spacing between each post 200 and the center of the exit end 76 is assured.

The right stanchion post 200 (as viewed from the front in FIG. 6) is connected to outwardly extending, upper and lower closure bell cranks 250 and 252. The upper closure crank 250 is pivotally suspended from the adjacent upper set of ears 82, whereas the lower closure crank 252 is pivotally mounted on the ears 82 therebelow. A removable extension arm 254 (shown in phantom lines) is selectively employed with either crank to gain increased mechanical leverage.

A series of sockets 256 are mounted on the outside of the left stanchion post 200 and spaced therealong as is clear in FIG. 2 (the sockets 200 are omitted in FIG. 6 for clarity). These sockets 256 selectively receive a pair of head-restraining bars 258 which are secured to the opposite post 200 in a generally horizontal attitude by such means as chains 260. The particular shape of each of the bars 258 is determined by the use thereof, it being contemplated that the upper bar 258 would lie across the neck of the bovine while the lower bar 258 would be adapted to fit across the bridge of the animal's nose.

An alternative means of securing and supporting the bovine's head is provided by a hinged frame 264 of inverted L-shaped configuration shown in FIGS. 1 and 7 in phantom lines. The overall configuration of the frame 264 is best seen in FIG. 7, such frame 264 having a base section 266 from which a pair of pins 267 project horizontally rearwardly and are received within a pair of sockets 268 in the front horizontal cross bracket 114 of the back support 92. A downwardly extending section 270 of the frame 264 is hinged on the base section 266 and has a series of bars therein (FIG. 1) to provide a head rest to which the animal's head may be secured. A brace 272 holds the section 270 in a selected stationary position to best suit the bovine's head.

OPERATION

The bottom of the stanchion-type head gate 198 is preset by depressing the foot pedal 242 (FIGS. 2 and 6) to raise the drop bar 230. The extension handle 254 is used to operate the lower bell crank 252 to set the distance between the lower ends of the stanchion posts 200. Upon release of the foot pedal 242, the bar 230 drops and the two locking pins 226 are received in the selected notches 228 corresponding to the neck thickness to be accommodated. This initial adjustment is accomplished very rapidly by the operator and the row of notches 228 permits a wide range of neck thicknesses to be accommodated. At this time with the bottom of the heat stanchion set, a V-shaped opening at the exit end is formed.

The bovine is either led or prodded into the entrance or drive end and urged forward until the neck of the animal is between the stanchion posts 200. At this time the operator employs the extension handle 254 to operate the upper bell crank 250 to close the top of the stanchion gate. This prohibits the animal from withdrawing its head or proceeding any further through the surgical table. The upper and lower spacing chains 222 and 246 assure that the stanchion posts 200 are uniformly spaced from the center of the exit end 76 regardless of the spacing required to accommodate a particular bovine.

More specifically, to close the top of the gate the extension handle 254 is swung downwardly to force the posts 200 toward each other. Such movement is permitted by the mechanism since the dogs 206 simply ride along the toothed upper edge 208 of the overhead plate 210. However, it may be appreciated that the posts 200 cannot be separated once closed against the neck of the bovine due to the interengagement of the dogs 206 and the teeth presented by edge 208.

Once the head of the bovine is captured, the squeeze sides of the cage or chute 36 are operated by inserting a hand crank (shown at 278 in phantom lines in FIG. 1) into the gear boxes 154 and 160. As has been discussed hereinabove, rotation of the lower lead screws 152 draws the sidewalls 126 and 128 uniformly toward each other at the bottom, whereas rotation of the upper lead screws 164 draws the sides toward each other at the top. It should be noted that the top and bottom restraint on the animal provided by the squeeze sides is independently adjustable to provide proper support for the animal and permit a very wide range of bovine sizes to be accommodated.

A very important feature of the table is the adjustable back support 92. The electric motor 106 is energized to lower the support 92 into overlying contact with the bovine's spine. Alternatively, a hand crank may be employed to rotate the shafts 94. Uniform lowering of the support 92 is assured by the timing chain 102 which synchronizes the four threaded shafts 94 and the corresponding vertical movement of the threaded blocks 108.

The restraining of the animal is completed by the use of either the two bars 258 (FIG. 2) or the hinged head rest arrangement shown in phantom lines in FIGS. 1 and 7. The internal cage 36 may now be rotated in the circular tracks 38 and 40 to roll the bovine to the desired position appropriate for a particular procedure. Ninety degree rotation (FIG. 4) places the bovine in lateral recumbency, and 180° of rotation (FIG. 5) places the animal in dorsal recumbency.

Figure 4:
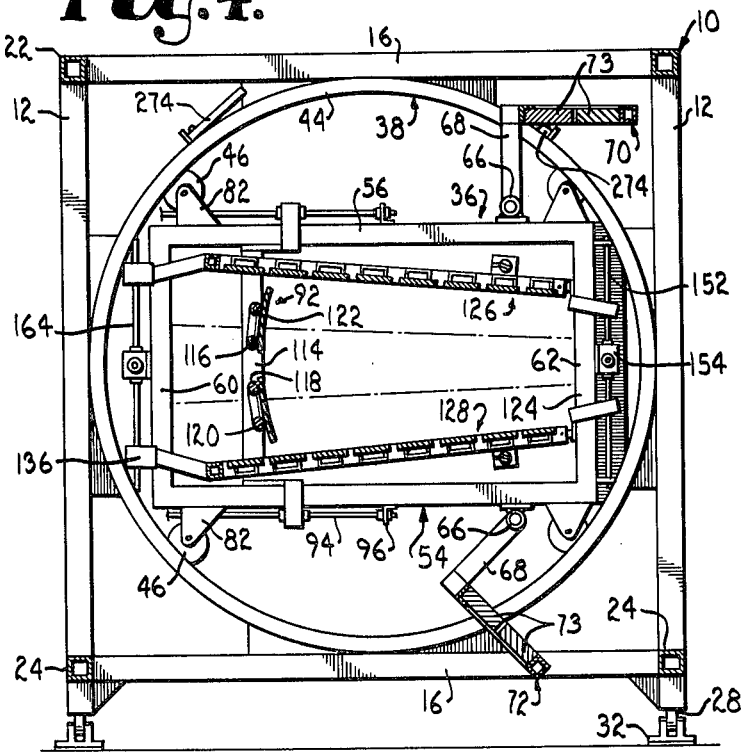
FIG. 4 is a vertical sectional view taken along line 4—4 of FIG. 1, the cage being rotated 90° counterclockwise from the position thereof shown in FIG. 3.
Figure 5:
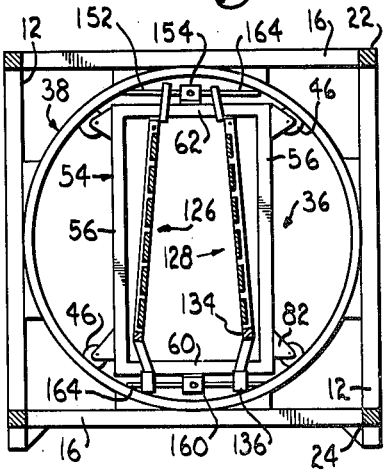
FIG. 5 is a partial schematic on a reduced scale and shows the cage rotated 180° relative to FIGS. 1—3.

It should be understood that the floor sections 70 and 72 are normally locked in the closed position by the use of such means as bolt-type latches (not shown). In the lateral position of the animal corresponding to the FIG. 4 illustration, such latches may be released and the floor sections 70 and 72 swung clear on their offset hinges 66 are shown, thereby permitting free and unrestricted access to the hooves, legs and belly of the bovine. If it is desired to restrain the bovine's legs, ropes are attached and secured to the cleats 190 on the winch shafts 188 and the winches are actuated to spread and firmly secure the legs.

Since the floor sections 70 and 72 are of heavy construction, it is important for the safety of the operator that the upper floor section 70 in the FIG. 4 attitude of the table be positively prevented from inadvertently swinging back toward the closed position. Accordingly, a bolt-type latch 274 is provided to positively lock the section 70 in the position illustrated clear of the working area.

In the dorsal position (FIG. 5) the selectively removable side panels 168 are advantageously utilized to provide the desired access. Removal of the panels 168 is accomplished by first removing the vertical brace 194 on the side where access is desired. Then, by grasping the handles 181 at the ends of the panels 186 and operating the respective locking devices 170, the panels are quickly and easily removed. It should also be understood that the back support 92 (upon which the bovine now rests) may be lowered once the cage 36 is rotated 180°, thereby lowering the bovine to a height that will accommodate the particular procedure. Such lowering of the back support 92 is accomplished by operating the threaded shafts 94 in a reverse rotational sense which, of course, raises the back support 92 when the table is in the normal position thereof prior to rotation of the cage 36.

When the procedure has been completed, the floor sections 70 and 72 are returned to normal (if opened during the procedure) and any removed side panels 168 are replaced. If the cage 36 has been rotated, the hydraulic motor 50 is again activated to return the table to its normal orientation. The head gate may now be instantly released by depressing the foot pedal 242 as discussed in a preceding section of this specification, and by pulling downwardly on a release lever 276 (FIG. 6) mounted on a pivot 220. The short, inner end of the lever 276 is beveled to a point and is inclined downwardly to underlie and engage the right end of the clearing bar 214. Accordingly, a downward pull on the relatively long handle of the lever 276 forces the bar 214 upwardly at an angle defined by the slot and pin connections 216. This applies a sharp upward force to the dogs 206 to release them from the toothed edge 208, thereby permitting the stanchion posts 200 to separate under the action of the springs 244 and an upper spring 245 connected to the upper end of the left post 200 (FIGS. 2 and 6), the locking pins 226 having also been released by the raising of the drop bar 230. The springs 244 and 245, being in tension, snap the posts 200 outwardly away from each other to open the gate instantly. This quick release feature of the head gate is especially important in instances where an animal may be in shock, as it permits the bovine to lunge forward and rise.

It should also be understood that the head gate has applications other than in a surgical table apparatus, as it provides a versatile and rapidly adjustable restraint for general purpose use. The drop bar and locking pin arrangement permits the opening to be quickly preset for a particular animal.

Furthermore, though not illustrated, the table is desirably provided with casters so that the apparatus can be easily moved about. In use, the hydraulic cylinders 26 are activated to lower the feet 32 and thereby raise the casters clear of the underlying floor surface.

Having thus described the invention, what is claimed as new and desired to be secured by Letters Patent is:

1. In a surgical table:

an animal-receiving cage having opposed, entrance and exit openings;

a pair of side-by-side stanchion posts at said exit opening, each of said posts having opposed, upper and lower ends;

means mounting said posts for movement inwardly toward each other to capture the neck of an animal therebetween, and outwardly away from each other to release the restrained animal;

locking means coupled with said posts for automatically holding the same in an animal-restraining position upon movement of said posts toward each other to said position; and quick-release means operably associated with said locking means for operating the latter to release said posts for outward movement away from said position, whereby to permit the animal to leave the cage through the exit opening, said locking means including locking components on said lower ends of the posts, a transversely extending holding bar selectively engageable with said components at any of a number of spacings between said lower ends of the posts to set the width of the exit opening at the bottom thereof, a transversely extending, toothed member adjacent said upper ends of the posts, and locking dogs on said upper ends engaging said member as said posts move inwardly toward each other to said animal-restraining position.

2. In the surgical table as claimed in claim 1, wherein is provided stanchion operating means connected with said posts for shifting the same inwardly to said position with said lower ends held at the selected spacing by said holding bar.

3. In the surgical table as claimed in claim 1, wherein said quick-release means includes shiftable release elements engageable with said bar and said dogs, and release operating means connected with said elements for actuating the same to cause said bar to disengage from said components and to move said dogs clear of said member.

4. In the surgical table as claimed in claim 3, wherein is provided yieldable means connected to said posts and biasing the same outwardly away from each other, whereby to provide a snap-action, instantaneous release of the animal upon operation of said quick-release means.

5. In a surgical table an animal-receiving cage having a frame and opposed, entrance and exit openings, said cage having means for selectively restraining and releasing an animal therein;

a floor in said cage having a pair of side-by-side sections each provided with a pair of mounting arms extending therefrom;

means mounting said cage for rotation about a central axis aligned with said openings to a selected treatment position; and offset hinge means on said frame mounting said floor sections for swinging movement to open positions clear of said cage, whereby to permit unrestricted access to the hooves, legs and belly of a restrained animal upon rotation of said cage, said hinge means comprising hinge devices connected with corresponding ends of said arms remote from said floor sections to define an offset hinge axis for each of said sections.

6. In a surgical table:

an animal-receiving cage having opposed, entrance and exit openings, and provided with a frame having normally upright frame members, said cage having a floor and structure for selectively restraining and releasing an animal standing on said floor, said structure including a vertically movable back support and selectively actuatable means connected with said support for shifting the same toward and away from said floor; and means mounting said cage for rotation about a central axis aligned with said openings to a selected treatment position, said back support including sleeve structures receiving corresponding frame members and shiftable therealong, back-engaging plate means, and frame means carried by said sleeve structures and supporting said plate means, said selectively actuatable means including a drive engaging said structures for uniformly raising and lowering the same on said members.

7. A head gate comprising:

a pair of side-by-side stanchion posts each having opposed, upper and lower ends;

means mounting said posts for movement inwardly toward each other to capture the neck of an animal therebetween, and outwardly away from each other to release the restrained animal;

locking means coupled with said posts for automatically holding the same in an animal-restraining position upon movement of said posts toward each other to said position;

quick-release means operably associated with said locking means for operating the latter to release said posts for outward movement away from said position; and yieldable means connected to said posts and biasing the same outwardly away from each other, whereby to provide a snap-action, instantaneous release of the animal upon operation of said quick-release means, said locking means including locking components on said lower ends of the posts, a transversely extending holding bar selectively engageable with said components at any of a number of spacings between said lower ends of the posts to set the width of the gate opening at the bottom thereof, a transversely extending, toothed member adjacent said upper ends of the posts, and locking dogs on said upper ends engaging said member as said posts move inwardly toward each other to said animal-restraining position.

8. The head gate as claimed in claim 7, wherein is provided stanchion operating means connected with said posts for shifting the same inwardly to said position with said lower ends held at the selected spacing by said holding bar.

9. The head gate as claimed in claim 7, wherein said bar has a series of notches therein defining said number of spacings between said lower ends of the posts, said components being receivable in selected notches.

10. The head gate as claimed in claim 7, wherein said quick-release means includes shiftable release elements engageable with said bar and said dogs, and release operating means connected with said elements for actuating the same to cause said bar to disengage from said components and to move said dogs clear of said member.

11. In a surgical table:

an animal-receiving cage having opposed, entrance and exit openings;

a pair of side-by-side stanchion posts at said exit opening, each of said posts having opposed, upper and lower ends;

means mounting said posts for movement inwardly toward each other to capture the neck of an animal therebetween, and outwardly away from each other to release the restrained animal;

locking means coupled with said posts for automatically holding the same in an animal-restraining position upon movement of said posts toward each other to said position; and quick-release means operably associated with said locking means for operating the latter to release said posts for outward movement away from said position, whereby to permit the animal to leave the cage through the exit opening, said locking means including locking components on said lower ends and locking elements on said upper ends of the posts, holding means selectively engageable with said components at any of a number of spacings between said lower ends of the posts to set the width of the exit opening at the bottom thereof, and independent locking means adjacent said upper ends of the posts and cooperable with said elements, said elements engaging said locking means as said posts move inwardly toward each other to said animal-restraining position to prevent separation of the posts by the restrained animal.

12. In the surgical table as claimed in claim 11, wherein is provided means connected to said posts for maintaining the same uniformly spaced from the center of said exit opening as the posts move inwardly and outwardly.

13. A head gate comprising:

a pair of side-by-side stanchion posts each having opposed, upper and lower ends;

means mounting said posts for movement inwardly toward each other to capture the neck of an animal therebetween, and outwardly away from each other to release the restrained animal;

locking means coupled with said posts for automatically holding the same in an animal-restraining position upon movement of said posts toward each other to said position;

quick-release means operably associated with said locking means for operating the latter to release said posts for outward movement away from said position; and yieldable means connected to said posts and biasing the same outwardly away from each other, whereby to provide a snap-action, instantaneous release of the animal upon operation of said quick-release means, said locking means including locking components on said lower ends and locking elements on said upper ends of the posts, holding means selectively engageable with said components at any of a number of spacings between said lower ends of the posts to set the width of the gate opening at the bottom thereof, and independent locking means adjacent said upper ends of the posts and cooperable with said elements, said elements engaging said locking means as said posts move inwardly toward each other to said animal-restraining position to prevent separation of the posts by the restrained animal.

14. In a surgical table:

an animal-receiving cage having opposed, entrance and exit openings, and provided with a frame having normally upright frame members, said cage having a floor and structure for selectively restraining and releasing an animal standing on said floor, said structure including a vertically movable back support and selectively actuatable means connected with said support for shifting the same toward and away from said floor; and means mounting said cage for rotation about a central axis aligned with said openings to a selected treatment position, said back support including sleeve structures receiving corresponding frame members and shiftable therealong, back-engaging plate means, and frame means carried by said sleeve structures and supporting said plate means, said selectively actuatable means including a drive coupled with said back support for uniformly shifting said structures along said members.

15. In a surgical table:

an animal-receiving cage having opposed, entrance and exit openings;

a floor in said cage;

a head gate at said exit opening for selectively restraining and releasing the neck of an animal in said cage, said cage having a pair of spaced, animal-squeezing sidewalls presenting opposed ends, an upper drive coupled with top portions of said sidewalls for shifting said top portions toward and away from each other, and a lower drive coupled with bottom portions of said sidewalls at the ends thereof for shifting said bottom portions toward and away from each other, said upper and lower drives being independently operable to provide separate adjustment of the spacing between the sidewalls at the top and bottom thereof, whereby to permit the anatomy of the animal to be properly accommodated and supported, said lower drive having a pair of gear devices associated with corresponding ends of said sidewalls, and a rotatable shaft adjacent said floor and operably interconnecting said devices; and means mounting said floor for movement away from a normal, animal-supporting position to a disposition clear of the cage to permit access to the belly portion of a restrained animal upon rotation of said cage, said shaft being removable from said devices to provide unhindered access to said belly portion when said floor is clear of the cage.

16. In the surgical table as claimed in claim 15, wherein said cage has, a vertically movable back support, and selectively actuatable means connected with said support for shifting the same toward and away from said floor.

17. In the surgical table as claimed in claim 15, wherein each of said drives includes a pair of rotatable lead screws adjacent respective ends of the sidewalls, and follower means on said sidewalls engaging said screws and responsive to rotation thereof.

18. A head gate comprising:

a pair of side-by-side stanchion posts each having opposed, upper and lower ends;

means mounting said posts for movement inwardly toward each other to capture the neck of an animal therebetween, and outwardly away from each other to release the restrained animal;

locking means coupled with said posts for automatically holding the same in an animal-restraining position upon movement of said posts toward each other to said position; and quick-release means operably associated with said locking means for operating the latter to release said posts for outward movement away from said position, whereby to release the animal upon operation of said quick-release means, said locking means including locking components on said lower ends and locking elements on said upper ends of the posts, holding means selectively engageable with said components at any of a number of spacings between said lower ends of the posts to set the width of the gate opening at the bottom thereof, and independent locking means adjacent said upper ends of the posts and cooperable with said elements, said elements engaging said independent locking means as said posts move inwardly toward each other to said animal-restraining position to prevent separation of the posts by the restrained animal.

* * * * *